United States Patent [19]

Peterson

[11] Patent Number: 4,846,470

[45] Date of Patent: Jul. 11, 1989

[54] ADJUSTABLE HEIGHT BASKETBALL GOAL AND BACKBOARD APPARATUS

[76] Inventor: Emil A. Peterson, 235 Abbott Pl., Tower Lakes, Ill. 60010

[21] Appl. No.: 113,214

[22] Filed: Oct. 23, 1987

[51] Int. Cl.[4] ..... A63B 63/08

[52] U.S. Cl. ..... 273/1.5 R; 248/284

[58] Field of Search ..... 273/1.5 R, 1.5 A; 248/558, 281.1, 284

[56] References Cited

U.S. PATENT DOCUMENTS

| | | | |
|---|---|---|---|
| D. 216,722 | 3/1970 | Minnette | 273/1.5 R X |
| 313,937 | 3/1885 | How | 248/281.1 |
| 537,771 | 4/1895 | Hirsh | 248/558 X |
| 619,445 | 2/1899 | Smith | 248/281.1 X |
| 1,789,363 | 1/1931 | Gross | 273/1.5 R |
| 2,313,188 | 3/1943 | Woodburn | 273/1.5 R |
| 2,831,689 | 4/1958 | Marsh | 273/1.5 R |
| 2,881,003 | 4/1959 | Drew | 273/1.5 R |
| 3,427,025 | 2/1969 | Procter | 273/1.5 R |
| 3,586,324 | 6/1971 | Bearson | 273/1.5 R |
| 3,765,676 | 10/1973 | Bearson et al. | 273/1.5 R |
| 3,802,702 | 4/1974 | Pulley | 273/1.5 R |
| 4,330,101 | 5/1982 | Andersen | 273/1.5 R |
| 4,395,040 | 7/1983 | White | 273/1.5 R |

*Primary Examiner*—Paul E. Shapiro

*Attorney, Agent, or Firm*—Welsh & Katz, Ltd.

[57] ABSTRACT

Adjustable height basketball goal and backboard apparatus is disclosed which has three fixed length supporting arms and one variable length supporting arm. One end of each of the fixed length arms is hingedly secured to the back side of the backboard in a triangular array, and the other end of each of the fixed length supporting arms is hingedly secured to the wall in a corresponding triangular array. The fixed length supporting arms permit the backboard to be adjusted to any height within a range of heights, while maintaining the front side of the backboard vertically with respect to the ground when the backboard is moved within the range. One end of a variable length arm is secured to the wall, and the other end is secured to one of the fixed length arms. The length of the variable length arm determines the height of the backboard within the range of heights available. The height of the backboard may be adjusted vertically within the range for use by players of different heights.

2 Claims, 2 Drawing Sheets

ADJUSTABLE HEIGHT BASKETBALL GOAL AND BACKBOARD APPARATUS

This invention relates to basketball goal and backboard apparatus, and more particularly to basketball goal and backboard apparatus which can be adjusted vertically for use at different heights.

BACKGROUND OF THE INVENTION

Basketball is a popular sport which is played in gymnasiums, playgrounds, home driveways and alleys by people of all ages. It is played with a basketball and at least one basketball goal which is a predetermined distance from the ground. The goal is secured to a backboard which in turn is secured to a pole, suspended from a ceiling or secured to a wall. In home use, the backboard is often secured to a garage wall over the garage door.

The standard height of a basketball goal is 10 feet from the ground. This is too high for young people who are not tall enough to throw the basketball through the goal at that height, however, so a goal must be provided at a lower height for those people to play the game.

Adjustable height basketball goals and backboards have been disclosed which permit the goal to be placed at one height for tall players, and another height for shorter players. Such adjustable apparatus sometimes includes four fixed length supporting arms which suspend the backboard a predetermined distance from a wall or the like, at least one variable length arm which fixes the position of the backboard at a desired height, and an array of structural supports interconnected among the fixed length arms.

One problem with such adjustable backboard apparatus is that it is quite heavy and difficult to adequately secure to a home garage wall or the like, particularly by home users. In some cases, it might be necessary to provide added support in the wall to which the apparatus is attached if the apparatus were to put excessive strain on the wall.

Another problem is that the high number of pieces of material needed to make such apparatus work adds cost to the system. Such added cost is particularly undesirable in the home consumer market.

Yet another problem is that the number of structural cross braces needed for such systems makes home assembly difficult and time-consuming. Thus, there is a need for adjustable height basketball goal and backboard apparatus which is relatively light in weight, easy to secure to a home garage wall or the like without having to add extra support for the wall, easy for consumers to assemble and install, and relatively simple and inexpensive.

Accordingly, one object of this invention is to provide new and improved adjustable height basketball goal and backboard apparatus.

Another object of this invention is to provide new and improved adjustable height basketball goal and backboard apparatus which is relatively light in weight and may be secured to a home garage wall or the like without requiring added support for the garage wall.

Yet another object of this invention is to provide new and improved adjustable height basketball goal and backboard apparatus which is relatively easy to assemble and install.

A still further object of this invention is to provide new and improved adjustable height basketball goal and backboard apparatus which is relatively inexpensive.

SUMMARY OF THE INVENTION

In keeping with one aspect of this invention, adjustable height basketball goal and backboard apparatus includes three fixed length supporting arms and one variable length supporting arm. One end of each of the fixed length arms is hingedly secured to the back side of a basketball backboard in a triangular array, and the other end of each of the fixed length supporting arms is hingedly secured to the wall in the same triangular array. The fixed length supporting arms permit the backboard to be adjusted to any height within a range of heights, while maintaining the front side of the backboard vertically with respect to the ground as the backboard moves within the range.

One end of a variable length arm is secured to one of the fixed length arms or to the back side of the backboard, and the other end is secured to the wall. The length of the variable length arm determines the height of the backboard within the range of heights available. In this manner, the height of the backboard may be adjusted vertically within the range for use by players of different heights.

BRIEF DESCRIPTION OF THE DRAWINGS

The above mentioned and other features of an embodiment of this invention and the manner of obtaining them will become more apparent, and will be best understood by reference to the following description, taken in conjunction with the accompanying drawings in which.

DETAILED DESCRIPTION

Figure 1:
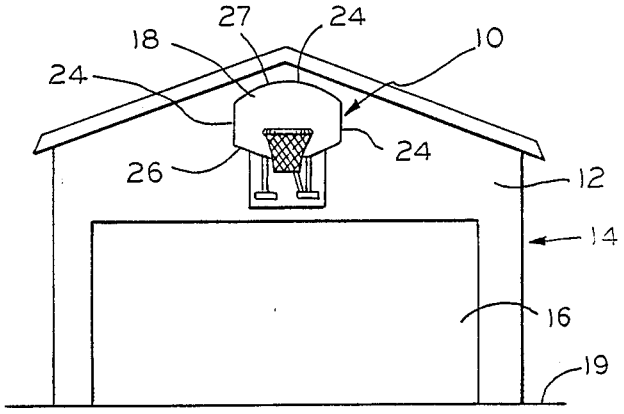
FIG. 1 is an elevation view of an embodiment of the invention secured to a garage wall.

As seen in FIG. 1, adjustable height basketball goal and backboard apparatus 10 is secured to a wall 12 which is part of a garage 14. The garage 14 includes a door 16 which, when closed, extends to the ground 19. While the apparatus 10 is shown attached to the garage wall 12, it is contemplated that the apparatus 10 could be secured to a pole or other suitable structure, if desired.

Figure 2:
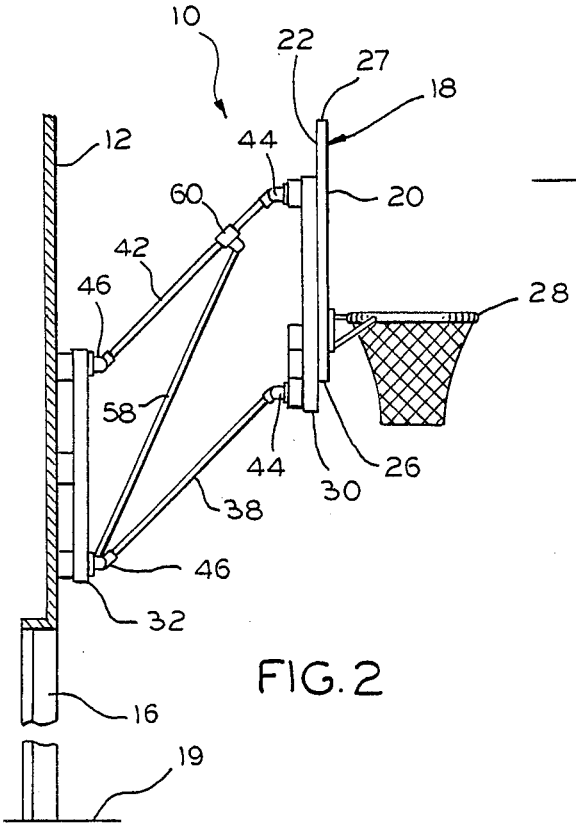
FIG. 2 is a side elevation view of the an embodiment of the invention showing a backboard in a raised position.

The apparatus 10 includes a basketball backboard 18 having a front side 20 and a back side 22 (FIG. 2). The backboard 18 is defined by several sides 24 (FIG. 1), including a lower edge 26 and an upper edge 27.

A basketball goal 28 (FIG. 2) is secured to the front side 20 of the backboard 18 by any suitable structure. The backboard 18 and the goal 28 are preferably standard sizes, and the goal 28 is preferably secured to the backboard so that the goal is a standard distance from the lower edge 26 of the backboard 18.

A frame 30 is secured to the back side 22 of the backboard 18. A similar frame 32 is secured to the wall 12 of the garage 14. The frames 30, 32 may be made of wood or any suitable material. The frame 32 is shown in greater detail in FIG. 5. The frame 32 includes several wooden members 34 secured in any suitable manner such as that shown in the drawings. A plurality of bolts or screws 36 are provided as needed to secure the frame 32 to the wall 12.

Figure 6:
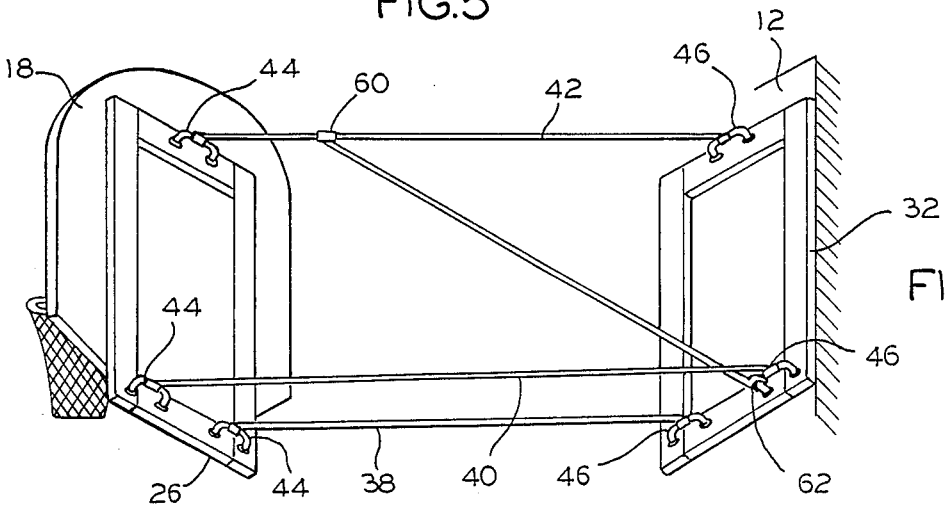
FIG. 6 is a perspective view of an alternate embodiment of the apparatus of FIG. 2.

As seen in FIGS. 2 and 6, three fixed length supporting arms 38, 40, 42 are hingedly secured between the frame 30 and the frame 32 in FIG. 2 (the frame 30 is not shown in FIG. 6, as will be described). One end 44 of each of the arms 38, 40, 42 is hingedly secured to the frame 30 in FIG. 2 (or the backboard 18 in FIG. 6), and the other end 46 of each of the arms 38, 40, 42 is hingedly secured to the frame 32.

Figure 5:
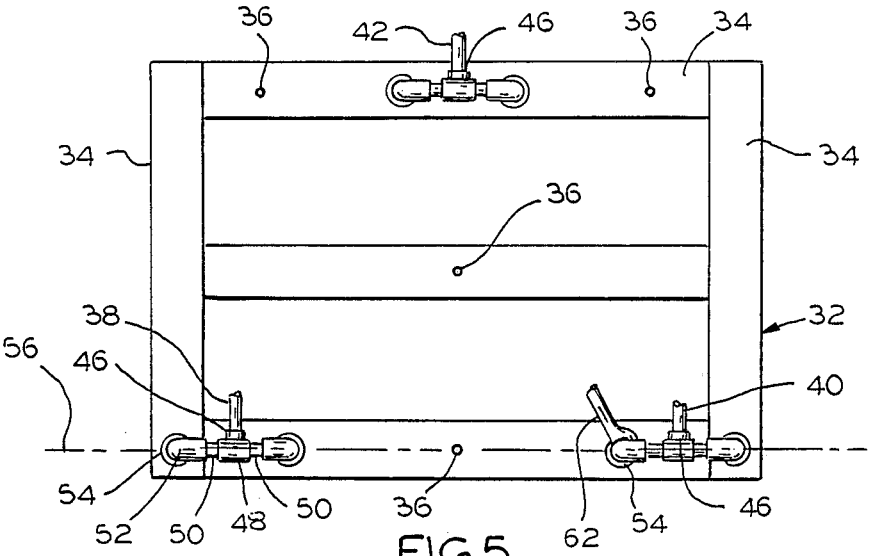
FIG. 5 is an elevation view of a frame used in the apparatus of FIG. 2.
Figure 10:
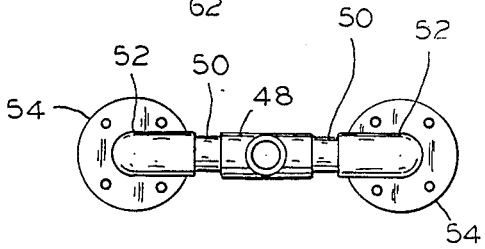
FIG. 10 is an elevation view of a hinge connection for the apparatus of FIG. 2.
Figure 11:
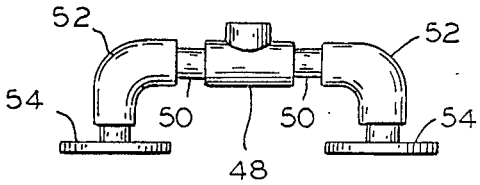
FIG. 11 is a plan view of the hinge connection of FIG. 10.

The ends 44 and 46 may be hingedly secured by any suitable means, including that shown in FIGS. 5, 10 and 11. The arms 38, 40, 42 are threaded pipe or the like, and are threaded to a "T" connection 48. The "T" connection 48 is threaded to two small pieces of pipe 50, which are threaded to elbows 52, which in turn are secured to bases 54. The bases 54 are secured to the frames 30, 32. The use of threaded pipe has been found to reduce sway to an acceptable level, without the need for additional cross-braces and the like. By using threaded pipes and fittings, sway can be reduced during installation by merely tightening the fittings and pipes. Other ways of connecting the arms are also contemplated, as will be seen.

As seen in FIG. 6, the frame 32 can be eliminated by connecting the arms 38, 40, 42 directly to the backboard 18. It is also contemplated that the frame 30 could be eliminated, if desired. The elimination of the frames further reduces the weight and complexity of the apparatus 10.

The ends 46 (FIG. 5) and the ends 44 (FIG. 6) of the arms 38, 40, 42 are each arranged in a triangular array. The wall array formed by the ends 46 is substantially the same as the backboard array formed by the ends 44. A variety of triangular arrays could be used, provided that the arrays permit the backboard 18 to be moved up and down while maintaining the front side 20 of the backboard 18 in a vertical position with respect to the ground 19.

The backboard array shown in FIG. 5 accomplishes this purpose, and provides a stable design with only three arms. The ends 46 of the arms 38, 40 are arranged in a line 56 which is substantially parallel to the ground 19, and is located adjacent the lower portion of the frame 32. The corresponding ends 44 of the arms 38, 40 are located adjacent to the lower edge 26 of the backboard 18 (FIG. 6). The end 46 of the arm 42 (FIG. 5) is secured to the top of the frame 32, in about the center of the frame, between the ends 46 of the arms 38, 40. The end 44 of the arm 42 (FIG. 6) is likewise located adjacent the upper edge 27 of the backboard 18, between the ends 44 of the arms 38, 40.

The wall array shown in FIG. 5 is a substantially equilateral triangle having one side (between the ends of the arms 38 and 40) which is substantially parallel to the ground 19, and a vertex at the end of the arm 42). The backboard array complements the wall array and also has a side between the ends of the arms 38 and 40 which is substantially parallel to the ground 19 (and is adjacent to the lower edge 26) and a vertex at the end of the arm 42 (adjacent to the upper edge of the backboard).

Figure 4:
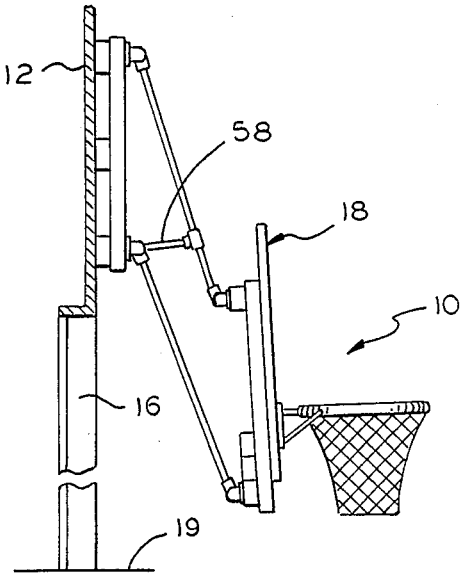
FIG. 4 is a side elevation view of the apparatus of FIG. 2 with the backboard in a still lower position.
Figure 3:
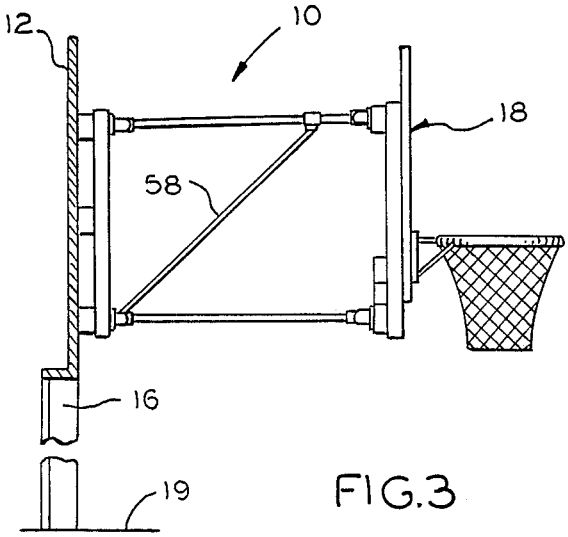
FIG. 3 is a side elevation view of the apparatus of FIG. 2 with the backboard in a lower position.

The arrangement of the arms 38, 40, 42 permits the backboard 18 to be moved vertically within a range of heights from the ground 19, as seen in FIG. 2, 3 and 4, maintaining the backboard substantially vertical with respect to the ground throughout the range. FIG. 2 shows the backboard in a relatively high position from the ground 19. FIG. 3 shows the backboard in a lower position, closer to the ground 19, and FIG. 4 shows the backboard in a still lower position, quite close to the ground. In practice, if the arms are about 3 feet long, the backboard 18 can be adjusted so that the goal 28 is between about 10 and 5 feet from the ground. Greater ranges can be realized by increasing the length of the arms.

The height of the backboard 18 is determined by a variable length arm 58 (FIG. 2). The arm 58 can be a single arm which is contractible and expandable, or several arms which can be easily substituted to obtain different heights. Thus, in FIGS. 2, 3 and 4, for example, three different arms 38 of different lengths are used, while FIGS. 7 and 8 show a single device which can be adjusted to different lengths, as will be described.

The arm 58 may be secured in many different configurations, including the configuration shown in FIGS. 2, 3 and 4. One end 60 of the arm 58 is secured to the arm 42, and the other end 62 (FIG. 5) is secured to the connector 54 adjacent to the end 46 of the arm 40.

The arm 58 need not be connected to the midsection of the arm 42, as shown in FIG. 5. It could be secured to the end 44 of the arm 42, for example, in the center of the side of the triangle defined by the ends of the arms 38, 40, or in some other manner which would hold the backboard in place. However, it is preferable to secured the arm 58 to the arm 42 a distance of about 25% of the length of the arm 42 from the end 44, to obtain acceptable leverage so that the backboard 18 can be easily raised and lowered.

Figure 8:
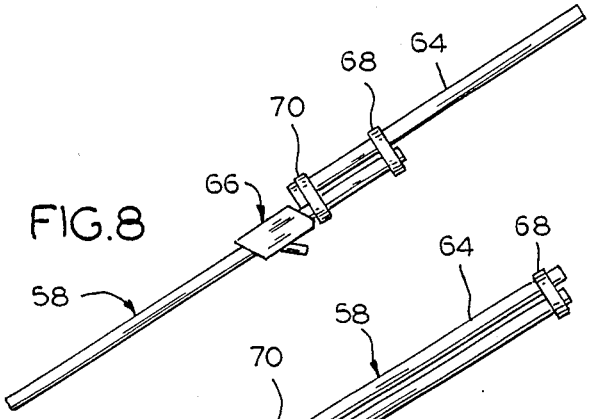
FIG. 8 is another elevation view of the variable length arm of FIG. 7, showing the arm in an extended position.
Figure 7:
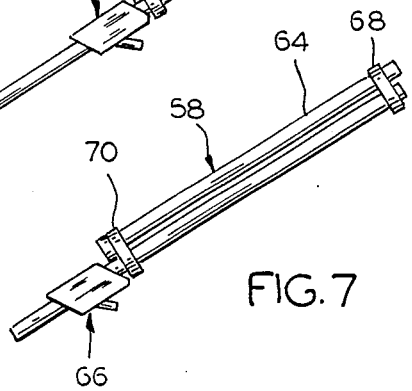
FIG. 7 is an elevation view of an alternate embodiment of the variable length arm of the apparatus of FIG. 2, showing the arm in a contracted position.

The arm 58 shown in FIGS. 7 and 8 can be contracted or expanded as desired. The arm 58 includes a pipe 64 and a ratchet device 66 which could be a car jack or the like. The pipe 64 and jack 66 are secured together by bands 68, 70, which slide as required to permit the pipe 64 and jack 66 to interact properly.

Figure 9:
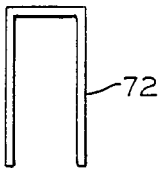
FIG. 9 is an end view of an alternate embodiment of one of the arms of the apparatus of FIG. 2.

While pipe can be used for the arms 38, 40, 42 and 58, "U" shaped material 72 can also be used, such as that shown in FIG. 9. Other shapes, such as "T" shapes and "I" shapes, are also contemplated. Instead of the pipe fittings used to obtain hinged connections, the "U" shaped arms can be connected through the use of oversized "U" brackets and bolts.

The invention may be used by adjusting the length of the arm 58 to obtain the desired height of the backboard and goal. The height may be changed for players of different heights, and may also be changed to move the apparatus up and out of the way. For example, the backboard could be lowered to allow young people to play basketball, and raised out of the way of the garage door to gain access to the garage. In a playground, the apparatus could be lowered for use by small children and raised for older children or so that other games could be played.

The advantages of this invention are not apparent. The adjustable height basketball goal and backboard apparatus taught herein is relatively light in weight and easy to secure to a home garage wall or the like without having to add extra support for the wall. The apparatus is easy for consumers to assemble and install, and is relatively simple and inexpensive.

While the principles of the invention have been described above in connection with specific apparatus and applications, it is to be understood that this description is made only by way of example and not as a limitation on the scope of the invention.

I claim:

1. Adjustable height basketball goal and backboard apparatus which may be secured to a wall or the like comprising a basketball backboard having a front side and a back side defined by several edges including a lower edge and an upper edge, a basketball goal secured to said front side of said backboard, three fixed length supporting arms, one end of said fixed length arms being hingedly secured to said back side of said backboard in a triangular array, the other end of said fixed length supporting arms being hingedly secured to said wall in substantially the same triangular array, said triangular array of said backboard being substantially an equilateral triangle having one side which is substantially parallel to and adjacent to said lower edge of said backboard, and a vertex which is adjacent to said upper edge of said backboard, said fixed length supporting arms being hingedly secured to said backboard and said wall by threaded connections, each of said threaded connections including a "T" connection having two opposing horizontal legs and a perpendicular leg extending outwardly from between said horizontal legs, said fixed length supporting arms being secured to said perpendicular legs, each of said horizontal legs being threadedly and rotatably secured to and between a pair of elbows for rotation of said "T" connection with respect to said elbows, said elbows at one end of said arms being fixedly secured to said backboard and at the other end of said arms being fixably securable to said wall, said fixed length supporting arms and said "T" connections permitting said backboard to be adjusted to any height within a range of heights, said fixed length supporting arms maintaining said front side of said backboard vertically with respect to the ground when said backboard is moved within said range, and a variable length arm secured to said apparatus, the length of said variable length arm determining the height of said backboard within said range, one end of said variable length arm being secured adjacent to said wall approximate to said side of said wall triangular array which corresponds to said lower edge of said backboard, the other end of said variable length arm being secured to said fixed length arm which is adjacent to said upper edge of said backboard, whereby the height of said backboard may be adjusted vertically within said range for use by players of different heights, without supporting arms or cross-braces in addition to said three fixed supporting arms and said variable length arm.

2. The apparatus of claim 1 wherein said other end of said variable length arm is secured to said fixed length arm a distance of about 25% of the length of said fixed length arm from said vertex.

* * * * *

UNITED STATES PATENT AND TRADEMARK OFFICE

CERTIFICATE OF CORRECTION

PATENT NO. : 4,846,470

DATED : July 11, 1989

INVENTOR(S) : Emil A. Peterson

It is certified that error appears in the above-identified patent and that said Letters Patent is hereby corrected as shown below:

Column 4, line 45, change "secured" to --secure--.

Column 5, line 6, change "not" to --now--.

Signed and Sealed this

Nineteenth Day of February, 1991

*Attest:*

HARRY F. MANBECK, JR.

*Attesting Officer*

*Commissioner of Patents and Trademarks*